US006706980B1

(12) United States Patent
Narasimhan

(10) Patent No.: US 6,706,980 B1
(45) Date of Patent: Mar. 16, 2004

(54) GALLIUM BASED ELECTRICAL SWITCH DEVICES USING EX-SITU AND IN-SITU SEPARATION OF OXIDES

(75) Inventor: Dave Narasimhan, Flemington, NJ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/254,463

(22) Filed: Sep. 25, 2002

(51) Int. Cl.[7] ..... H01H 35/14
(52) U.S. Cl. ..... 200/61.47; 200/220; 200/233
(58) Field of Search ..... 200/61.47, 182, 200/220, 233, 234

(56) References Cited

U.S. PATENT DOCUMENTS 4,023,266 A * 5/1977 Lovell et al. ..... 29/879
5,391,846 A * 2/1995 Taylor et al. ..... 200/233
5,478,978 A * 12/1995 Taylor et al. ..... 200/233
5,751,074 A * 5/1998 Prior et al. ..... 307/118
5,792,236 A * 8/1998 Taylor et al. ..... 75/715
6,313,417 B1 * 11/2001 Schnell ..... 200/61.47
6,323,447 B1 * 11/2001 Kondoh et al. ..... 200/182
6,544,353 B2 * 4/2003 Bonneviot et al.
6,570,110 B2 * 5/2003 Narasimhan

* cited by examiner

*Primary Examiner*—Karl D. Easthom
*Assistant Examiner*—K. Lee

(57) ABSTRACT

A gallium based switch or sensor devices, and a process for producing such devices, in which gallium or a gallium alloy, the surface oxide is separated either in-situ or ex-situ and placed in a switching capsule. Reagents which separate the oxide without dissolving either gallium alloy or the oxide are found and can be used in the in-situ or ex-situ configurations. In-situ fluids separate the oxide layer allowing switch functionality. A electrically non-conducting carrier liquid may contain the oxide separating agent and may be used within the switching capsule. The oxide separating fluid further prevents oxidation of the metal or alloy and thereby prevents wetting of the capsule surface by the metal or alloy to allow for good electrical performance of the switch.

16 Claims, 1 Drawing Sheet

GALLIUM BASED ELECTRICAL SWITCH DEVICES USING EX-SITU AND IN-SITU SEPARATION OF OXIDES

FIELD OF THE INVENTION

The invention is in the field of electrical switches and sensors, in particular, electrical switches and sensors relying on a liquid metal or metal alloy as an electrical conducting material for bridging an electrical gap between electrodes.

BACKGROUND OF THE INVENTION

Electrical switches and sensors that are usually referred to as "tilt" switches, such as thermostats, float controls, solenoids, relays, etc. are commonly used in a variety of electrical applications. The making or breaking of electrical contact in these switches, hence the electrical switching action, is generally accomplished by mechanical movement of the switch which causes a quantity of a bridging conducting material contained therein to flow from one location to another. Liquid mercury is used extensively in such electrical switches and sensors as the bridging conducting material.

In a typical switch application, liquid mercury is positioned inside a capsule or housing into which spaced apart electrodes or electrical contacts extend. Depending on the physical orientation of the housing, the liquid mercury can provide a conductive pathway between the electrodes, or be positioned such that there is an open circuit between the electrodes. The switch is closed and electrical contact made when the switch housing is moved in a manner such that the quantity of mercury flows toward a location in the housing at which the mercury bridges the spaced electrodes, thereby permitting the flow of electricity from one electrode to the other. Conversely, the switch is opened and electrical contact broken when the switch housing is moved in a manner such that the quantity of mercury flows towards and collects at a different position in the switch housing out of contact with at least one of the electrodes.

An important physical attribute of mercury for the purposes of electrical switch applications, aside from its ability to conduct electricity, is that it remains fluid throughout a wide temperature range thus enabling it to be used in many different environments, or in environments with constantly changing temperature parameters. Another important physical attribute of mercury is that it has significant surface tension and does not wet glass, metal or polymer surfaces.

A problem with mercury-based electrical switches is that mercury is toxic to humans and animals, and exposure to mercury is a significant concern in any application or process in which it is used. Utilization of mercury during manufacturing may present a health hazard to plant personnel, and the disposal of devices that contain mercury switches or the accidental breakage of mercury switches during use may present an indirect hazard to people within the immediate vicinity of the switch.

As a result of the toxicity of mercury, non-toxic replacements for mercury in electrical switch applications have been sought. A candidate for replacing mercury in electrical switches is liquid gallium metal or liquid gallium alloys. For example, U.S. Pat. No. 3,462,573 (Rabinowitz et al.) and Japanese Patent Application Sho 57-233016 to Inage et al. each disclose that gallium or gallium alloys may be useful as a replacement for mercury in electrical switches.

However, while gallium is non-toxic, it does not have all of the beneficial properties of mercury. For example, an important shortcoming of gallium and gallium alloys in electrical switch and sensor applications is the propensity of the gallium or gallium alloy to become oxidized. Even slight oxidation of gallium may be detrimental to the performance of the switch or sensor because oxidation of the metal reduces the surface tension of the metal in the liquid phase and may lead to wetting of the switch housing, unwanted bridging of the electrodes, sluggish movement of the metal, and poor contact between the metal and the electrodes. In U.S. Pat. No. 5,792,236 (Taylor et al.), it was recognized that gallium and gallium alloys are readily oxidized when exposed to ambient air, and that oxidized gallium alloys wet a number of materials, including glass. Taylor discusses that when the oxides in the metal components in the gallium alloy were removed and the formation of oxides during and after switch fabrication were prevented, the gallium alloy would not wet the switch housing material. To overcome this particular problem, Taylor discloses that the removal of the oxide from the metals may be accomplished by washing the metals in HCl, 30% NaOH, or other acids, bases, or reducing agents, and that after the oxides are removed, further oxidation of the metals should be avoided. Taylor discloses a multifaceted solution to the problem involving removal of the oxides from the metal constituents of the gallium alloy and maintaining the gallium alloy in an oxide free state prior to dispensing the alloy into a switch housing, and, because of the recognized rapid speed of oxidation of gallium or gallium alloys, the use of specialized dispensing apparatus designed to prevent oxide formation on the alloy during dispensing of the alloy into the switch housing. Taylor also discloses that coating the interior of the switch housing with a fluoroalkyl acrylate polymer prevents wetting of the housing by the gallium alloy, but it is noted that this coating of the polymer to the housing does not prevent stickiness to the electrodes. While these techniques may improve the functionality of gallium in an electrical switch or sensor, this would appear to require complex equipment and involve cumbersome processes for making electrical switches.

Further limitations of the prior art may be that washing the metal in acid, alkali or in a reducing agent to dissolve the oxide or chemically reduce it to gallium involves using strong chemical agents which attack the oxides on the gallium alloy. Traces of such chemical agents have to be removed from the gallium alloy prior to placement into a switch housing since the presence of a small quantity of these strong chemical agents will leave behind an oxide layer or in the long term will attack and deteriorate the gallium alloy surface thus compromising its surface tension and non wetting character. Taylor's patents describe separating the metallic parts from the aqueous acid or base reacting liquid and the gallium containing melt, but do not address removing traces of these strong chemical agents by repeated washings in deionized water. Water used for dissolving the acid, alkali or reducing agent generally has dissolved oxygen which may be a problem since this dissolved oxygen will re-oxidize the gallium alloy. Therefore, water free from dissolved oxygen and the reaction process, separation of the gallium alloy and the filling of the switch housing has to be done in inert, non-oxidizing conditions to prevent re-oxidation of gallium alloy.

In view of the drawbacks and problems with the prior art, a need exists for a novel approach to gallium-based electrical switch construction which will reduce or eliminate such drawbacks and problems.

SUMMARY OF THE INVENTION

The present invention provides gallium based switch or sensor devices, and a process for producing such devices using either in-situ or ex-situ separation of oxides from gallium or gallium alloys. The separation of oxides from gallium or gallium alloy in accordance with an embodiment of the present invention may be accomplished, and an oxide free state maintained, within the switch or sensor capsule or housing itself (in-situ), in which case the separation of oxides from the gallium or gallium alloy may be more efficiently carried out, and the switches or sensors may be less costly to produce, than the steps of the prior art. The separation in accordance with other embodiments of the present invention may also be carried out prior to the filling of a capsule or housing with gallium or gallium alloy (ex-situ).

Some embodiments of the present invention use oxide removing agents, either as a liquid or a gas, that are not strong enough to dissolve the oxide on the surface of the gallium or gallium alloy, but rather which physically separate the oxide from the gallium or gallium alloy surface so that the surface tension and non wetting properties of gallium or gallium alloy are realized. Since these oxide separating agents are chemically mild in regards to the gallium or gallium alloy, they do not need to be washed away and can be tolerated inside the electrical switch in prolonged contact with the gallium or gallium alloy. In some embodiments, the oxide separating agents may be combined with other electrically non-conducting fluids which are referred to herein as carrier fluids. In some embodiments, the oxide separating agents may be dilute solution of hydrazine in water, formic acid in water, oxalic acid in water, or 25% ammonium hydroxide. The oxide separating agents have the surprising effect of separating or "peeling off" the oxide layer away from the gallium alloy surface resulting in a highly rounded gallium alloy ball. In some embodiments, ammonia gas may also be used as an oxide separating agent, and has a similar effect of peeling the surrounding gallium oxide layer. Ammonia gas is also sufficiently non-conductive to tolerate the electrical requirements of the switching device. Hydrazine gas may also be used as an oxide separating agent in some embodiments of the present invention.

In accordance with some embodiments of the present invention, a switch or sensor capsule or housing may be filled with gallium or gallium alloy that is oxidized without recourse to any prior cleaning and handling procedures. A thermodynamically stable system is attained within the housing or capsule that maintains the gallium or gallium alloy in an oxide-free state exhibiting high surface tension characteristic of the gallium alloy.

In accordance with some embodiments of the present invention, there is provided an electrical device comprising a housing of an electrically non-conducting material, the housing defining a sealed cavity, at least two spaced electrodes, each electrode extending through the housing into the cavity, a moveable amount of liquid gallium or liquid gallium alloy within the cavity of the housing to electrically connect and disconnect any two of said at least two electrodes as a result of movement of the housing, and an amount of oxide separating agent within the cavity to separate any oxides from the gallium or gallium alloy and to maintain the gallium or gallium alloy substantially oxide free thereby maintaining the gallium or gallium alloy in a liquid ball that does not wet the material of the housing and that flows readily within the housing in response to changes in the orientation of the housing. In other embodiments, the material of the housing may be glass.

In accordance with other embodiments of the present invention, there is further provided an electrical switch or sensor comprising a housing of an electrically non-conducting material, the housing defining a sealed cavity, at least two spaced electrodes, each electrode extending through the housing into the cavity, a moveable amount of liquid gallium or liquid gallium alloy within the cavity of the housing to electrically connect and disconnect any two of said at least two electrodes as a result of movement of the housing, and an amount of oxide separating agent within the cavity to separate any oxides from the gallium or gallium alloy and to maintain the gallium or gallium alloy substantially oxide free thereby maintaining the gallium or gallium alloy in a liquid ball that does not wet the material of the housing and that flows readily within the housing in response to changes in the orientation of the housing. In other embodiments, the material of the housing may be glass.

There is further provided a method of producing an electrical switch or sensor having a moveable amount of liquid gallium or liquid gallium alloy as an electrical conducting material for bridging an electrical gap between at least two spaced electrodes, the method comprising the steps of providing a container of non-electrically conducting material, the container having an opening and a container wall that defines a cavity, providing at least two spaced electrodes, each electrode extending through the container wall into the cavity, adding an amount of liquid gallium or liquid gallium alloy into the cavity of the container sufficient to electrically connect and disconnect any two of said at least two electrodes as a result of movement of the housing, adding an amount of oxide separating agent into the cavity to separate any oxides from the gallium or gallium alloy and to maintain the gallium or gallium alloy substantially oxide free thereby maintaining the gallium or gallium alloy in a liquid ball that does not wet the material of the housing and that flows readily within the housing in response to changes in the orientation of the housing, and sealing the opening of the container so that the gallium or gallium alloy and the oxide separating agent become sealed within the container.

There is further provided a method of cleaning gallium or gallium alloy to remove surface oxides comprising the step of treating the gallium or gallium alloy with an oxide separating agent.

In some embodiments of the above, the oxide separating agent may be hydrazine solution, formic acid solution, oxalic acid solution, ammonium hydroxide solution, hydrazine gas or ammonia gas. The gallium alloy may be an alloy comprised of gallium (Ga), indium (In), and tin (Sn), such as for example, 62.5% gallium (Ga), 21.5% indium (In), and 16% tin (Sn).

There is further provided the use of hydrazine solution, formic acid solution, oxalic acid solution, ammonium hydroxide solution, hydrazine gas or ammonia gas for separating surface oxides from gallium or gallium alloy.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Some embodiments of the present invention may be further understood from the following detailed description, with reference to the figures in which.

DETAILED DESCRIPTION OF THE INVENTION

Figure 1:
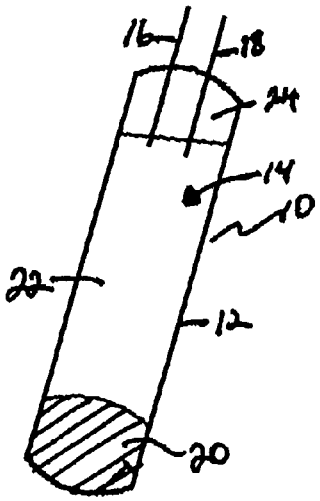
FIG. 1 is a vertical sectional view of a gallium-based electrical switch in accordance with an embodiment of the present invention shown in a position where the electrical circuit of the switch is open.

Some embodiments of the present invention provide gallium based switch or sensor devices, and processes for producing such devices using either in-situ or ex-situ separation of oxides from gallium or gallium alloys to provide oxide free gallium or gallium alloy within the switch housing by using an oxide separating agent to separate the oxide from the gallium or gallium alloy surface.

In some embodiments, oxide separation is accomplished ex-situ of the switch or sensor housing by treating the gallium alloy with mild cleaning agents, such as for example, hydrazine in water, formic acid in water, oxalic acid in water or ammonium hydroxide. The oxide layer is separated from the gallium alloy and ends up as a tiny agglomerate of the oxide away from the gallium alloy surface. The gallium alloy melt may then be separated by filtering or density separation, and dispensed into a switch housing under a non-oxidizing atmosphere, as in the prior art. However, no further washing of the metal is needed since the relatively mild oxide separating agents do not attack the gallium alloy.

In some embodiments, the oxide containing gallium alloy may be treated with ammonia gas which has a similar effect of peeling the oxide films away from the alloy to provide a gallium melt with good surface tension and non-wetting characteristics. In this case, the oxide containing gallium alloy is filled into a container from which it is dispensed into the switch housings. The filling operation is conducted in an inert atmosphere enriched with ammonia gas, preferably in the range of approximately 20 to 100%. In some embodiments, hydrazine gas may be used.

In some embodiments, oxide separation is accomplished in-situ of the switch or sensor housing. This may be is carried out by adding into a switch housing or capsule having embedded electrodes, an amount of gallium or gallium alloy together with an amount of oxide separating agent. The surface of the gallium or gallium alloy may be in an oxidized state at the time of adding it into the switch housing. The oxide separating agents may be, for example, hydrazine in water, formic acid in water, oxalic acid in water, or ammonium hydroxide. Ammonia gas or hydrazine gas may also be used as an oxide separating agent. The level of the oxide-separating agent may be low enough so that all of the electrodes do not contact this separating agent simultaneously to prevent electrical conduction and chemical breakdown. In some embodiments, the oxide separating agents may be incorporated into a non-conductive carrier fluid, and the resultant solution may be dispensed into the housing. The carrier fluid, if used, should be electrically non-conducting so that the electrical switching action occurs only when the gallium or gallium alloy contacts at least two of the electrodes extending into the switch housing. For example, carrier fluids may include silicones, fluorinated solvents, and the like which are dielectric fluids which do not conduct electricity and are generally inert and do not attack the gallium alloy or the electrodes.

The oxide separating agent if used in small quantity need not be electrically non-conducting, since a thin film of it remains on the gallium alloy. However, if it is used in greater quantities such that it bridges the electrodes, it has to be non conducting so that the electrical current through the switch is turned on and off only through contact of the electrodes with the gallium metal or alloy. Examples of such non-conducting oxide removing agents include hydrazine, formic acid, oxalic acid and ammonium hydroxide. The capsule may be filled with gallium alloy and a dielectric non-conducting carrier fluid. In the second case, the fluid may be gaseous ammonia or hydrazine compositions with inert gases. Ammonia gas is preferred due to its low toxicity and ease of use. Preferably, the oxide separating agent is selected such that it separates the surface oxide of the gallium or gallium alloy under ambient or near ambient conditions under which the switch functions and maintains the gallium surface clean preserving the surface tension and non-wetting characteristic. It may also be preferable that the oxide separating agent readily dissolves in the chosen carrier fluid if a carrier fluid is used.

After addition of the gallium or gallium alloy and oxide separating agent into a switch housing, the switch housing is then sealed to encapsulate the oxide separating agent (either by itself or in solution with a carrier fluid), and the gallium or gallium alloy. The oxide separating agent removes oxides from the surface of the liquid gallium or gallium alloy and prevents the surface from becoming oxidized thereby maintaining the liquid gallium or gallium alloy in a free flowing state and preventing it from wetting the switch housing or the electrodes.

In some embodiments, either liquid gallium or liquid gallium alloys of a wide variety of metals (e.g., silver, gold, lead, thallium, cesium, palladium, platinum, sodium, selenium, lithium, potassium, cadmium, bismuth, indium, tin, antimony, etc.) may be used to practice the present invention. However, since an object of the replacement of mercury in these kinds of electrical switches is to minimize the use of toxic materials in such common switch applications, the use of toxic substances in gallium alloys should be avoided.

Gallium/indium/tin alloys may have particular potential as a mercury substitute and are commercially available. Typically, the primary component of the gallium/indium/tin alloy is gallium and it constitutes approximately 60–75% of the composition. Indium is generally incorporated in the composition at level of 15–30% and tin is incorporated at a level of 1–16%. In electrical switch applications that require performance at or below the freezing point of water, adding small quantities (less than 5%) of other elements such as lithium, sodium, rubidium, silver, antimony, gold, platinum, cesium and bismuth to the gallium/indium/tin alloy provides a mechanism for depressing the freezing point of the alloy.

The aforementioned embodiments of the present invention may be more fully understood by referring to the following examples which are given to illustrate the practice of the invention rather than to limit the scope thereof.

EXAMPLE 1

Water in a glass beaker was heated to about 70° C. and Ga pellets were dispensed into the water. The Ga melted, but a layer of surface scum (oxide) on the smaller Ga melts prevented them from forming into a continuous melt layer. Also, the Ga did not flow readily. A few drops (5) of hydrazine monohydrate were added to the water, and very quickly all the oxide scum was gone. The Ga formed one continuous, shiny melt pool or ball which did not wet the glass. The single ball of Ga was observed to move around and deform readily in response to physical agitation, but the ball could not be broken into many smaller balls of gallium by shaking the beaker thereby indicating good surface tension. The liquid of water with hydrazine monohydrate developed a slight cloudiness, which may be the result of the oxides that were separated, or "peeled" away from the gallium melt. The shiny Ga ball in the liquid medium was examined under a microscope. The Ga ball surface was shiny, and a few specks of oxide were observed floating freely in the liquid just above the gallium surface.

EXAMPLE 2

In a glass beaker, 4 grams of Ga—In—Sn alloy was heated to approximately 30° C. until the Ga melted. The Ga melt readily wetted the glass beaker. 5 grams water were added to the beaker at room temperature. The wetting of the Ga melt to the beaker persisted, and the melt exhibited a layer of scum on its surface and did not form a shiny ball. Individual beads of gallium melt were observed as separate areas with interlaced surface scum. 3 grams of formic acid were added to the beaker and the temperature of the contents were raised to 80° C. The gallium melt lifted up off from the glass and formed a shiny ball. The shiny ball was free moving and could not be broken down by shaking of the beaker, thereby indicating high surface tension. Slight cloudiness of peeled oxides was observed in the formic acid and water solution. The sample was left undisturbed for several months, and precipitates of the oxides were observed dispersed in the liquid.

EXAMPLE 3

4.6 grams of 512E alloy (Ga—In—Sn eutectic alloy), which is liquid at room temperature, was added to 0.5 grams of water in a glass beaker at room temperature. The eutectic alloy wetted the glass of the beaker. The water and alloy were heated to approximately 90° C., and 0.5 grams of formic acid was then added to the beaker. In approximately 2 minutes, the 512E alloy lifted up from the glass surface to form a shiny gallium alloy ball. The shiny ball and the liquid medium was examined under a microscope at 40× and a few specks of oxide were observed floating away from the gallium alloy and floating freely in the liquid medium. The sample was left undisturbed for several months, and precipitates of the oxides were observed dispersed in the liquid.

EXAMPLE 4

5.18 grams water was mixed in a glass beaker with 0.0204 gram of oxalic acid. The liquid was heated to 90C. Approximately 4 grams of alloy 512E (Ga—In—Sn eutecic) was added to the liquid. The shiny ball immediately formed peeling oxide layer from the alloy. Microscopic examination of the shiny ball and liquid medium at 40× shows very few oxide specks surrounding the gallium alloy ball. Long term (3 months) settling of the oxalic acid liquid precipitates the 'peeled' oxides.

EXAMPLE 5

In a glass beaker containing 6 grams of ammonium hydroxide (25% solution) at room temperature, 5 grams of molten 512E gallium indium tin eutectic alloy was added. Even though the alloy contacted the walls of the glass beaker, it did not wet the glass and immediately formed a shiny ball. The shiny gallium alloy ball could not be broken up into smaller balls by shaking, indicating good surface tension. Examination of the ammonical liquid showed some cloudiness, which may be due to peeled oxides. Long term settling of the ammonical liquid precipitates the 'peeled' oxides.

EXAMPLE 6

Molten gallium alloy 512E was injected at room temperature into a closed vial with ammonia gas and hydrogen (50%—50% volume fraction). The gallium alloy ball became shiny and moved freely in response to tilting of the vial, and could not be broken down into many gallium alloy balls thus indicating good surface tension. Microscopic examination of the gallium alloy ball in the closed vial shows small amount of scum on the melt surface, which was seen localised by the peeling action of the gas mixture. This switch element was tested by passing 1–6 amperes of current and breaking the surface. The presence of ammonia in the gas phase changes the color of the arc but does not interfere with the performance of the switch.

Figure 2:
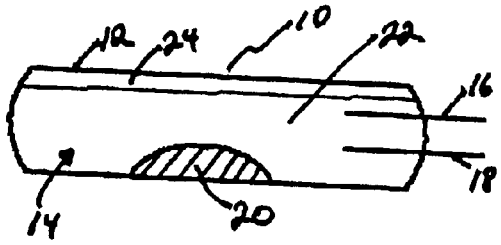
FIG. 2 is a vertical sectional view of the gallium-based electrical switch of FIG. 1 also show in a position where the electrical circuit of the switch is open, but the switch is oriented horizontally.
Figure 3:
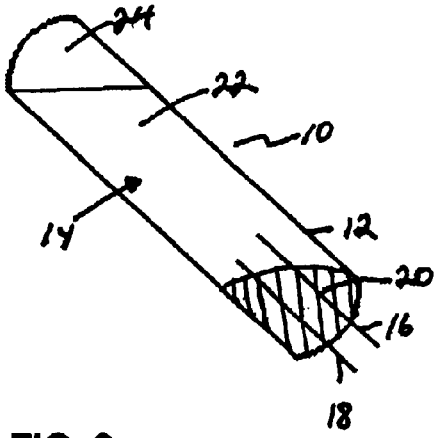
FIG. 3 is a vertical sectional view of the gallium-based electrical switch of FIGS. 1 and 2 shown in a position where the electrical circuit of the switch is closed.

Referring to FIGS. 1, 2 and 3, there is illustrated an electrical switch in accordance with an embodiment of the present invention. In FIG. 1, the electrical switch 10 is shown in a position wherein the electrical circuit through the switch is open. Electrical switch 10 is comprised of ampoule, capsule or housing 12 that defines cavity 14. Housing 10 is usually made out of glass, but may be made out of any other suitable non-electrically conductive material as would be apparent to a person skilled in the art. At least two spaced electrodes 16 and 18 are provided such that each electrode extends through the housing 12 into the cavity 14 so as to be able to conduct electricity from the cavity 14 to outside of the housing. It will be understood that more than two electrodes may be used and there may be many possible configurations of electrodes to provide the desired electrical switching action, which are within the scope of the present invention. Within the cavity 14 is provided a melt pool or amount of liquid gallium or a liquid gallium alloy 20 in an amount sufficient to electrically connect and disconnect any two electrodes as a result of movement of the housing. Also provided in cavity 14 is oxide separating agent 22, either on its own or in solution, which bathes the liquid gallium or liquid gallium alloy 20.

In FIG. 1, electrical switch 10 is physically oriented in a manner such that the amount of liquid gallium or liquid gallium alloy 20 does not bridge electrodes 16 and 18 such that an electric current may not flow between the electrodes.

Referring to FIG. 2, there is illustrated the electrical switch 10 of FIG. 1 shown in a generally horizontal position with the liquid gallium or gallium alloy being in a position part way toward the electrodes 16 and 18.

Referring to FIG. 3, the electrical switch 10 is shown in a position wherein the electrical circuit through the switch is closed. The switch 10 is physically oriented such that the amount of liquid gallium or liquid gallium alloy 20 bridges the spaced electrodes 16 and 18 as shown thereby connecting the electrodes electrically.

In the illustrated embodiment of the present invention, oxide separating agent 22 is shown to substantially fill cavity 14 such that the amount of liquid gallium or liquid gallium alloy 20 remains bathed in oxide separating agent 22 throughout all positions of the electrical switch. In alternative embodiments of the present invention, oxide separating agent 22 may be provided in a smaller amount such that it does not completely cover the amount of liquid gallium or liquid gallium alloy 20. Of course, as is illustrated in FIG. 4, if the oxide separating agent 22*a* is a gas, it will completely fill cavity 14.

The embodiments of the present invention illustrated in FIGS. 1–3 is shown to have a gas space 24 on top of a liquid oxide separating agent, and gas space 24 may be filled with an inert gas to further reduce the possibility of the liquid metal from being oxidized. The latter arrangement is preferred if the amount of oxide separating agent 22 in a liquid form does not completely cover the liquid gallium or liquid gallium alloy 20, since the ball of gallium rotates within the fluid as it moves within the capsule. In other embodiments of the present invention, the oxide separating agent 22 may be provided in an amount which completely fills any space remaining in cavity 14 above the liquid gallium or liquid gallium alloy.

Figure 4:
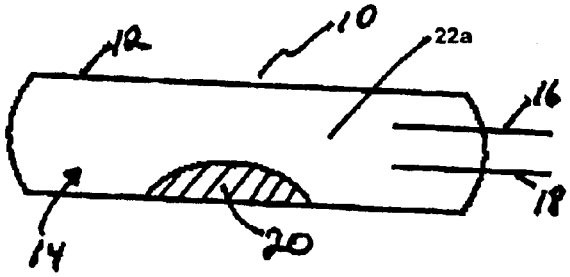
FIG. 4 is an alternative embodiment of a gallium-based electrical switch that contains a gaseous oxide separating agent.

It should be noted that FIG. 4 can also be used to graphically illustrate an electrical switch in which the gallium or gallium alloy has been cleaned ex-situ in accordance with some embodiments of the present invention. In such case, reference number 22*a* would represent an inert atmosphere within the cavity 14, and reference number 20 would represent oxide-free gallium or gallium alloy that has had surface oxides removed by treatment with an oxide separating agent, for example hydrazine, formic acid, oxalic acid or ammonium hydroxide, ex-situ of the switch housing 12 prior to the gallium or gallium alloy being dispensed into the switch housing.

While specific embodiments of the invention have been described and illustrated, such embodiments should be considered illustrative of the invention only and not as limiting the invention as construed in accordance with the accompanying claims.

What is claimed is:

1. An apparatus for making and breaking an electrical connection in an electrical circuit, the apparatus comprising:

a) a housing of an electrically non-conducting material, the housing defining a sealed cavity;

b) at least two spaced electrodes, each electrode extending through the housing into the cavity;

c) a moveable amount of liquid gallium within the cavity of the housing to electrically connect and disconnect any two of said at least two electrodes as a result of movement of the housing; and d) an oxide separating agent within the cavity in an amount necessary to cover the gallium or gallium alloy in all positions of the housing so as to separate any oxides from the gallium and to maintain the gallium substantially oxide free thereby maintaining the gallium in a liquid ball that does not wet the material of the housing and that flows readily within the housing in response to changes in the orientation of the housing.

2. The apparatus in claim 1 wherein the gallium alloy is an alloy comprised of gallium (Ga), indium (In), and tin (Sn).

3. The apparatus in claim 1 wherein the oxide separating agent is hydrazine solution.

4. The apparatus in claim 1 wherein the oxide separating agent is formic acid solution.

5. The apparatus in claim 1 wherein the oxide separating agent is oxalic acid solution.

6. The apparatus in claim 1 wherein the oxide separating agent is ammonium hydroxide solution.

7. The apparatus in claim 1 wherein the oxide separating agent is hydrazine gas.

8. The apparatus in claim 1 wherein the oxide separating agent is ammonia gas.

9. A method of producing an electrical switch comprising the steps of:

a) providing a container of non-electrically conducting material, the container having an opening and a container wall that defines a cavity;

b) providing at least two spaced electrodes, each electrode extending through the container wall into the cavity;

c) adding an amount of liquid gallium or liquid gallium alloy into the cavity of the container sufficient to electrically connect and disconnect any two of said at least two electrodes as a result of movement of the housing;

d) adding an oxide separating agent into the cavity in an amount necessary to cover the gallium or gallium alloy in all positions of the housing so as to separate any oxides from the gallium or gallium alloy and to maintain the gallium or gallium alloy substantially oxide free thereby maintaining the gallium or gallium alloy in a liquid ball that does not wet the material of the housing and that flows readily within the housing in response to changes in the orientation of the housing; and e) sealing the opening of the container so that the gallium or gallium alloy and the oxide separating agent become sealed within the container.

10. The method of claim 9 wherein the gallium alloy is an alloy comprised of gallium (Ga), Indium (In), and tin (Sn).

11. The method in claim 10 wherein the oxide separating agent is hydrazine solution.

12. The method in claim 10 wherein the oxide separating agent is formic acid solution.

13. The method in claim 10 wherein the oxide separating agent is oxalic acid solution.

14. The method in claim 10 wherein the oxide separating agent is ammonium hydroxide solution.

15. The method in claim 10 wherein the oxide separating agent is hydrazine gas.

16. The method in claim 10 wherein the oxide separating agent is ammonia gas.

* * * * *